US005107601A

United States Patent [19]

Semchuck

[11] Patent Number: 5,107,601

[45] Date of Patent: Apr. 28, 1992

[54] MOUNTING TEMPLATE

[75] Inventor: Mario E. Semchuck, Chatsworth, Calif.

[73] Assignee: Emhart, Inc., Newark, Del.

[21] Appl. No.: 511,043

[22] Filed: Apr. 19, 1990

[51] Int. Cl.[5] ..... B25H 7/00

[52] U.S. Cl. ..... 33/759; 33/667; 33/563

[58] Field of Search ..... 33/758, 759, 494, 562, 33/566, 563, 528, 520, 667

[56] References Cited

U.S. PATENT DOCUMENTS

| | | | |
|---|---|---|---|
| D. 137,340 | 2/1944 | Lozier . | |
| D. 238,762 | 2/1976 | Black . | |
| D. 249,271 | 9/1978 | Boarman . | |
| D. 284,089 | 6/1986 | Hines . | |
| D. 288,538 | 3/1987 | Cabaniss, III . | |
| 212,353 | 2/1879 | Caro | 33/562 |
| 2,187,087 | 1/1940 | Leary | 33/758 |
| 2,733,517 | 2/1956 | Gjersoe . | |
| 2,805,485 | 9/1957 | Krummel | 33/563 |
| 3,795,983 | 3/1974 | Gallagher et al. | 33/563 |
| 3,797,120 | 3/1974 | Byne | 33/758 |
| 4,149,320 | 4/1979 | Troyer et al. | 33/758 |
| 4,345,381 | 8/1982 | Brislin | 33/528 |
| 4,367,590 | 1/1983 | Winter et al. | 33/758 |
| 4,461,086 | 7/1984 | Segletes . | |
| 4,515,077 | 5/1985 | Davidson et al. . | |
| 4,640,019 | 2/1987 | Paley | 33/563 |
| 4,845,858 | 7/1989 | Thomas | 33/759 |
| 4,928,399 | 5/1990 | Kragt | 33/562 |

FOREIGN PATENT DOCUMENTS

| | | | |
|---|---|---|---|
| 2115374 | 9/1983 | United Kingdom | 33/563 |

*Primary Examiner*—Thomas B. Will

*Attorney, Agent, or Firm*—J. Bruce Hoofnagle

[57] ABSTRACT

A mounting template 10 is formed from a flexible strip 12 of paper material and has indicia printed or formed on a first face 14 thereof. The indicia defines hole patterns A, B, C and D each of which include circles 18 representing hole locations. A rear or second face 16 of the strip 12 has applied thereto a low-tack pressure-sensitive backing 28 of adhesive material which is covered by a removable cover 30. The mounting template 10 can be adhesively mounted on a wall surface and the indicia provides precise and accurate locations of holes to be formed in the surface. The holes facilitate attachment of brackets to the surface which support, for example, bathroom fixtures or accessories.

12 Claims, 1 Drawing Sheet

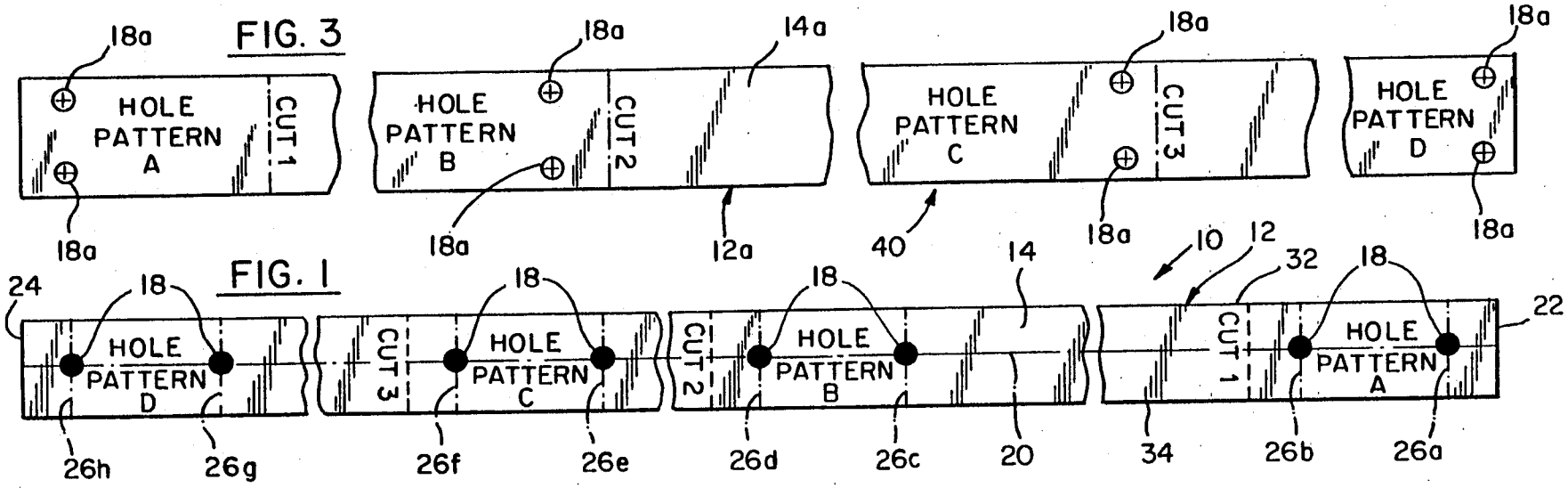
FIG. 3
FIG. 1
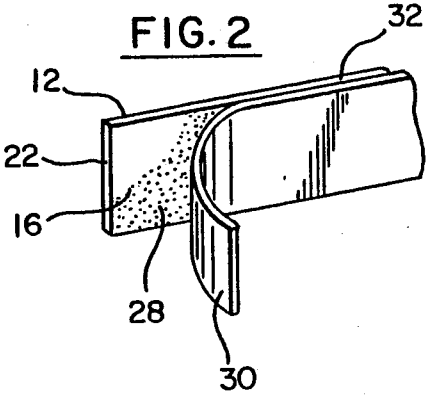
FIG. 2

MOUNTING TEMPLATE

BACKGROUND OF THE INVENTION

This invention relates to a mounting template and particularly relates to a template for facilitating the location on a surface at which an object is to be mounted.

Frequently, a plurality of matching bracket-supported fixtures or accessories are to be mounted on supporting wall surfaces in a precise pattern for utility and aesthetic purposes. For example, accessories which are wall-mounted in a bathroom could include a towel ring, a shelf, a tumbler holder, a soap dish, a toilet paper dispenser and various lengths of towel bars all of which could combine to provide utilitarian purposes while, at the same time, being mounted in such a manner to be pleasing to the eye. Typically, a bathroom could include all of these accessories. When mounting such accessories on the wall surface of the bathroom, it is important that mounting holes be formed in the wall, which is usually a dry wall, at precise locations to receive and support mounting assemblies of each of the accessories to be mounted.

Usually, the mounting assemblies include mounting brackets with each bracket having a pair of holes through which threaded fasteners are mounted to attach the bracket to a wall surface. In a typical assembly technique, the brackets to be mounted are analyzed and measured to obtain necessary measurements such as, for example, hole spacing as well as spacing between brackets where multiple brackets are used to mount a single accessory. The wall locations are selected and the measurements are marked on the wall surface, taking care to insure that the location of the ultimately-formed mounting holes are level and properly spaced. The holes are then formed in the wall surface and the mounting assemblies are then installed in the holes. Thereafter, the accessories are attached to and supported by the assembled brackets.

The above-described process requires precise measurements which must be obtained from the brackets and transferred as markings on the wall surface. Frequently, minor errors occur when transferring the measurements which result in a defective mounting installation thereby requiring correction. A tool, such as a bubble level, should be used to insure the desired alignment in forming the holes and to insure proper orientation of the holes. Otherwise, the mounted items could present an obvious tilt which not only could destroy the utilitarian purpose but could also be unpleasing to view. When drilling or forming holes in a dry wall, it may be useful to take extra precaution to cover the area whereat the hole will be drilled with adhesive-backed tape to avoid chipping away the dry wall exterior surrounding the location of the hole.

In any event, this entire process is time consuming, tedious and fraught with opportunities for making mistakes which result in defective installation and presents a shoddy appearance which is unpleasing to the eye.

Consequently, there is a need for a facility or device which will ease the burdens associated with the installation procedure noted above while providing successful results.

SUMMARY OF THE INVENTION

It is an object of this invention to provide a mounting template which is useful in assisting in the installation of objects on a surface.

It is another object of this invention to provide a mounting template which is simple to use and which has versatility to permit the wall installation of single or spaced mounting assemblies in contemplation of mounting accessories of the same or different configurations.

With these and other objects in mind, this invention contemplates a mounting template which includes a strip of material having a first face on one side thereof and a second face on the other or opposite side thereof. Indicia is located on the first face of the strip and represents at least one mounting location on a surface at which an object is to be mounted. The second face of the strip includes means for supporting the strip in engagement with the surface to provide for the use of the indicia in assisting in determining the mounting location on the surface. The template is further provided with means for defining the area of the strip which encompasses and includes the indicia and which is to be supported in engagement with the surface.

Other objects, advantages and novel aspects of this invention will become apparent upon review of the following detailed description, taken in conjunction with the following illustrations.

BRIEF DESCRIPTION OF THE DRAWINGS

FIG. 1 is a front view showing a mounting template having indicia on a first face thereof, and embodying certain principles of the invention;

FIG. 2 is a perspective view showing a second face of the mounting template of FIG. 1 with adhesive material deposited thereon and with a cover paper peeled away from a portion of the second face and embodying certain principles of the invention, and FIG. 3 is a front view showing another embodiment of a mounting template having indicia on a first face thereof and embodying certain principles of the invention.

DETAILED DESCRIPTION OF THE PREFERRED EMBODIMENT

In the assembly of matching accessories or fixtures in a room, the fixtures frequently have a common mounting theme which enhances the task of assembly. For example, in a bathroom, such fixtures as a towel ring, a shelf, a tumbler holder, a soap dish, a toilet paper dispenser and towel bars of various lengths are typically mounted on a mounting surface such as the walls of the bathroom. One manner of mounting these fixtures includes the use of mounting assemblies such as intermediate brackets which are usually formed with two spaced mounting holes and are secured to the mounting surface. Initially, precisely located holes are drilled or formed in the surface and other elements of the mounting assemblies such as threaded anchoring devices are then used to secure the brackets to the surface. Accommodating structure formed on the rear of the fixture is assembled with the wall-mounted bracket or brackets to complete the mounting of the fixture.

Mounting systems of this type typically require a single bracket for such accessories as a towel ring, a robe hook, a soap dish and a tumbler holder. The toilet paper dispenser requires two brackets. While the lengths of the towel bars could vary, typical towel bars are twenty-four inches and thirty inches in length and each requires two brackets as do a toilet paper holder/-dispenser and a shelf.

During the installation process, the general wall location of the fixture is selected. The installer measures the hole spacing of the two holes of the bracket and transfers the measurements to the wall mounting surface, hopefully taking care to insure that the hole locations are properly aligned for level support of the fixture. The installer could use another technique by placing the bracket against the wall mounting surface and marking the hole locations directly onto the surface through the bracket holes. In either event, holes are then formed in or through the wall and threaded anchoring devices are used to attach the bracket to the mounting surface. The complimentary structure of the fixture is then positioned over the bracket to mount the fixture.

If the fixture requires two brackets, the above process of bracket mounting for the second bracket is repeated, again hopefully taking care to insure that the second set of holes is properly aligned with the first set of holes for level support of the fixture.

When following the above-described procedure, it is not uncommon to obtain and transfer the wrong hole spacing dimensions. Also, single brackets are occasionally and undesirably mounted in such a manner that the fixture is not level. Further, when using two brackets, the holes of the spaced brackets are misaligned such that the fixture which spans the spaced brackets is not level. Also, the procedure described above is time consuming and tedious.

As a solution to the problems described above, a mounting template 10 as shown in FIG. 1 is used to precisely determine the location where each bracket is to be installed on the wall surface.

Mounting template 10 is formed as a strip 12 of material from heavy weight paper which is flexible. Strip 12 is formed with a front or first face 14 and a rear or second face 16 (FIG. 2). Indicia is formed or printed on the first face 14 of strip 12 and includes hole patterns A, B, C and D, with each hole pattern representing a location of a mounting assembly such as the bracket to be attached to a surface such as the wall of a room. The indicia is typically machine printed or formed on the strip 12 and thereby insures the accurate locating of each of the hole patterns A, B, C and D as well as the precise spacing between hole patterns.

The indicia at each of the hole patterns A, B, C and D includes a pair of spaced circles 18 which are located at the cross points of a longitudinal centerline 20, which extends between strip ends 22 and 24, and each of a plurality of transverse centerlines **26*a* through 26*h*. Each circle 18** represents the size of the hole to be drilled or formed in or on the mounting surface of the wall.

Also, three dashed cut lines are printed or formed transversely on the first face 14 of strip 12 and are designated by the expressions CUT 1, CUT 2 and CUT 3.

As shown in FIG. 2, the second face 16 of strip 12 has applied thereto a low-tack pressure-sensitive backing 28 of adhesive material which, during periods of non-use, is covered by a removable cover 30 made from lightweight paper. The cover 30 precludes the adhesive backing 28 from engaging and adhering to surfaces undesirably. Thus, the adhesive backing 28 provides a means for supporting strip 12 in engagement with the surface on which the brackets are to be mounted but has a low-tack property so as not to peel off any portion of the surface to which the strip 12 is attached when the strip is removed..

When using mounting template 10, the various hole patterns A, B, C and D in conjunction with the cut lines CUT 1, CUT 2 and CUT 3, establish the hole locations and spacing between patterns for different fixtures. For example, the tumbler holder, the towel ring and soap dish each require a single bracket the mounting holes for which are represented by hole pattern A. The area of strip 12 which is to be used to establish the hole locations on the wall surface for the tumbler holder, the towel ring and soap dish is defined by strip side edges 32 and 34, strip end 22 and cut line CUT 1.

Initially, the entire strip 12 is used to facilitate locating the hole patterns for the spaced pair of brackets for the longer towel rack, i.e. the thirty inch rack. In this instance, a pair of the brackets are to be mounted with the predetermined spacing defined by hole pattern A and hole pattern D. The wall location for the larger towel rack is selected and cover 30 is removed. The second face 16 is adhesively attached to the wall surface in the selected wall location while maintaining centerline 20 in a horizontally level plane to insure ultimate level mounting of the towel rack. Because the hole patterns have been precisely formed or printed previously on strip 12, hole pattern A and hole pattern D present precise and accurate location and dimensions on the wall surface representing the locations where the pair of brackets are to be mounted or attached for the longer towel rack.

After attaching the mounting template 10 to the wall surface as described, a drill or other tool is used to form holes in line with the circles 18 of hole pattern A and hole pattern D whereby the holes provide mounting facilities for the brackets and threaded anchor devices. It is noted that the adhesive backing tends to support the area of the dry wall adjacent the hole locations as the holes are being formed and thereby provides a means for engaging and supporting areas of the mounting surface during the hole forming operation.

Thereafter, the strip 12 can be removed from the surface to reveal the mounting facilities formed by the two spaced sets of two holes each. A pair of the brackets are then positioned to align bracket holes with the holes formed in the mounting surface and threaded anchor devices such as, for example, screw anchors are used to securely attach the brackets to the wall mounting surface. Complimentary mounting structure on the rear of opposite ends of the towel rack is mounted on structure on the mounted brackets to thereby support the rack.

This process, which includes the use of the mounting template 10, provides an expeditious and accurate manner of mounting the brackets.

In order to mount the shorter towel rack or shelf, the strip 12 is severed along cut line CUT 3 and this portion of the strip is then adhesively attached to the wall surface at the selected location as described above. Hole pattern A and hole pattern C define the appropriate spacing between brackets for supporting the shorter towel rack. Holes are drilled or formed through the circle areas of hole pattern A and hole pattern C and into the wall surface to form the mounting facilities and the strip 12 is removed from the surface to reveal the holes in the wall. The spaced brackets are then mounted in the manner described above and the rack is assembled with the brackets.

In preparation for assembly of the toilet paper dispenser, the strip 12 is severed along cut line CUT 2 where hole pattern A and hole pattern B define the appropriate spacing between brackets. This portion of the strip 12 is then adhesively attached to the wall surface at the selected location and the holes are drilled or formed by use of the circle areas of hole pattern A and hole pattern B to provide the mounting facilities. The attached portion of the strip 12 is removed to reveal the holes in the wall. Thereafter, brackets are mounted and the dispenser is attached as described above.

In assembly of the tumbler holder, the towel ring or the soap dish, the remaining portion of strip 12 is severed along cut line CUT 1. The portion of the strip 12 which contains hole pattern A is then utilized in the manner previously described to assist in the forming of the holes. The bracket is then mounted and the towel ring or soap dish are then mounted on the bracket.

Thus, with template 10, a single or universal template can be used to locate hole positions for a variety of fixtures having different hole spacing requirements.

The preferred embodiment of the invention is illustrated in FIG. 3 and includes a mounting template 40 having hole patterns A, B, C and D. A pair of holes 18*a* for each pattern are aligned from side to side of a strip 12*a* rather than from end to end as shown on strip 12 (FIG. 1). Indicia is formed on a first face 14*a* of strip 12*a* representing the hole patterns. In addition, dashed cut lines are also formed on face 14*a*. Adhesive material is applied to the back side of strip 12*a* in the same manner as backing 28 (FIG. 2) is applied to second face 16 of strip 12. Template 40 is used in the same manner as template 10 except for accessories requiring vertically aligned holes 18*a* rather than horizontally aligned holes 18 (FIG. 1).

The following chart provides an assist for the user in determining which cut lines and hole patterns to use in locating the position of the holes for the various fixtures of both embodiments of FIGS. 1 and 3.

| Accessory | Cut Line Number | Hole Pattern |
|---|---|---|
| Towel Ring, Soap Dish Tumbler Holder | 1 | A |
| Toilet Paper Dispenser | 2 | A & B |
| 24-Inch Towel Bar Glass Shelf | 3 | A & C |
| 30-Inch Towel Bar | — | A & D |

While the foregoing description relates to the use of mounting templates 10 and 40 for determining hole locations for brackets used in mounting bathroom fixtures and accessories, this principle could be used to determine hole locations for other surfaces and fixtures such as, for example, small components on kitchen walls or under kitchen cabinets. Also, a template having different hole patterns as well as different hole-pattern spacing could be used without departing from the spirit and scope of the invention. In effect then, the principle embodied in mounting template 10 is universal and has widespread utility.

The above-described embodiments, of course, are not to be construed as limiting the breadth of the present invention. Modifications, and other alternative constructions, will be apparent which are within the spirit and scope of the invention as defined in the appended claims.

What is claimed is:

1. A mounting template for defining hole locations on a single support surface in preparation for forming holes at locations in the single support surface to facilitate the mounting of a first accessory object or a second accessory object on the single support surface, which comprises:

a single strip of material having a first face on one side thereof and a second face on a side opposite the one side;

indicia formed on the first face of the strip of material which includes:

a first mounting pattern defining the location of holes to be formed in the support surface for mounting the first accessory object;

a second mounting pattern in combination with the first mounting pattern defining the location of holes to be formed in the support surface for mounting the second accessory object by use of the combination of the first and second mounting patterns, and a cut line which is located adjacent one of the first or second mounting patterns and along which the strip of material is to be cut to separate the strip of material into two sections with one of the two sections including only the first mounting pattern to facilitate utilization of the first mounting pattern independently of the second mounting pattern to define the location of the holes for the first accessory object;

an adhesive material applied to the second face of the strip of material for removably supporting the strip of material in engagement with the support surface to provide for the use of the indicia in assisting in determining the location of the holes for the first and second accessory objects to be formed on the support surface;

a removable cover located over the adhesive material to prevent the adhesive material from undesirably contacting and adhering to other surfaces; and means for defining the area of the strip which encompasses and includes the indicia and which is to be supported in engagement with the support surface.

2. The mounting template as set forth in claim 1, wherein the strip of material is flexible.

3. The mounting template as set forth in claim 1, which further comprises means for engaging and supporting areas of the surface during periods when the surface is being formed with the holes in preparation for the attaching of the first or second accessory object to the surface.

4. The mounting template as set forth in claim 1, wherein:

the first mounting pattern is located on the single strip of material adjacent an end thereof, and the defining means includes the cut line being located between the first and second mounting patterns to define the area of the strip of material between the end of the strip and the cut line which is to be supported in engagement with the support surface during the forming of the holes in the support surface for the first accessory object by use of the first mounting pattern only.

5. The mounting template as set forth in claim 1, wherein:

the strip of material being formed with a first end at one end thereof and a second end at an end opposite the first end;

the first mounting pattern is located on the single strip of material adjacent the first end thereof, and the defining means includes the cut line located between the second mounting pattern and the second end of the strip to define the area inclusive of the first and second mounting patterns between the first end of the strip and the cut line which is to be supported in engagement with the support surface during the forming of the holes in the support surface for the second accessory object by use of the first and second mounting patterns.

6. The mounting template as set forth in claim 1, wherein:

the strip of material being formed with a first end at one end thereof and a second end at an end opposite the first end;

the first mounting pattern is located on the single strip of material adjacent the first end thereof;

the first and second mounting patterns being spaced by a first prescribed distance;

the indicia further includes a third mounting pattern spaced form the first mounting pattern by a second prescribed distance greater than the first prescribed distance and located between the second mounting pattern and the second end of the strip, and the third mounting pattern in combination with the first mounting pattern defining the location of holes to be formed in the support surface for a third accessory object by use of the first and third mounting patterns.

7. The mounting template as set forth in claim 6 wherein the cut line is a first cut line and wherein the defining means includes a second cut line located between the third mounting pattern and the second end of the strip to define the area of the strip between the first end of the strip and the second cut line which is to be supported in engagement with the surface during the forming of the holes in the support surface by use of at least the first and third mounting patterns.

8. The mounting template as set forth in claim 6 wherein the defining means includes the first end of the strip and the second end of the strip to define the area of the strip between the first end and the second end of the strip which is to be supported in engagement with the support surface during the forming of the holes in the support surface for the third accessory object by use of at least the first and third mounting patterns.

9. The mounting template as set forth in claim 6, wherein the indicia further includes:

a fourth mounting pattern spaced from the first mounting pattern by a third prescribed distance greater than the second prescribed distance and located adjacent the second end of the strip, and the fourth mounting pattern in combination with the first mounting pattern defining the location of holes to be formed in the support surface for a fourth accessory object by use of at least the first and fourth mounting patterns.

10. The mounting template as set forth in claim 9 wherein the defining means includes the first end of the strip and the second end of the strip to define the area of the strip between the first end and the second end of the strip which is to be supported in engagement with the support surface during the forming of the holes in the support surface for the fourth accessory object by use of at least the first and fourth mounting patterns.

11. A mounting template for defining hole locations on a single support surface in preparation for forming holes at the locations in the single support surface to facilitate the mounting of a first accessory object or a second accessory object on the support surface, which comprises:

a single strip of material having a first end and a second end spaced apart by a first prescribed distance and a first face on one side thereof and a second face on the opposite side thereof;

indicia representing at least a first mounting pattern and a second mounting pattern of hole locations formed on the first face of the strip and spaced apart by a second prescribed distance less than the first prescribed distance;

an adhesive material applied to the second face of the strip for supporting the strip of material in engagement with the support surface;

a removable cover located over the adhesive material to prevent the adhesive material from undesirably contacting and adhering to other surfaces;

a cut line located on the first face of the strip between the first and second mounting patterns and along which the strip can be cut;

the first and second ends of the strip defining the area of the strip inclusive of the first and second mounting patterns which is to be supported in engagement with the support surface when determining the locations at which holes of the first accessory object are to be formed by use of the first and second mounting patterns, and the first end of the strip and the cut line defining the area of the strip including the first mounting pattern only which is to be supported in engagement with the support surface when determining the locations at which holes of the second accessory object are to be formed by use of the first mounting pattern only.

12. The mounting template as set forth in claim 11 wherein the strip of material is flexible.

* * * * *